US012264859B2

(12) United States Patent
Rite et al.

(10) Patent No.: US 12,264,859 B2
(45) **Date of Patent: *Apr. 1, 2025**

(54) SYSTEMS AND METHODS FOR CHARGING REFRIGERANT INTO A CLIMATE CONTROL SYSTEM

(71) Applicant: Trane International Inc., Davidson, NC (US)

(72) Inventors: Raymond Walter Rite, Tyler, TX (US); Drew Whitehurst, Tyler, TX (US); Nathan Smith, Tyler, TX (US)

(73) Assignee: Trane International Inc., Davidson, NC (US)

( * ) Notice: Subject to any disclaimer, the term of this patent is extended or adjusted under 35 U.S.C. 154(b) by 269 days.

This patent is subject to a terminal disclaimer.

(21) Appl. No.: 18/047,222

(22) Filed: Oct. 17, 2022

(65) Prior Publication Data

US 2023/0074872 A1 Mar. 9, 2023

Related U.S. Application Data

(63) Continuation of application No. 16/804,769, filed on Feb. 28, 2020, now Pat. No. 11,506,433.

(51) Int. Cl.
*F25B 45/00* (2006.01)

(52) U.S. Cl.
CPC ..... *F25B 45/00* (2013.01); *F25B 2345/001* (2013.01); *F25B 2345/003* (2013.01)

(58) Field of Classification Search
CPC ..... F25B 45/00; F25B 2345/001; F25B 2345/003; F25B 2700/195; F25B 2700/21163
See application file for complete search history.

(56) References Cited

U.S. PATENT DOCUMENTS

| | | | |
|---|---|---|---|
| 7,866,172 | B2 | 1/2011 | Douglas et al. |
| 7,878,010 | B2 | 2/2011 | Nishimura et al. |
| 7,908,086 | B2 | 3/2011 | Bergery |
| 8,087,258 | B2 | 1/2012 | Toyoshima et al. |
| 8,215,119 | B2 | 7/2012 | Sakai et al. |
| 9,027,357 | B2 | 5/2015 | Chang et al. |
| 9,303,907 | B2 | 4/2016 | Kawano et al. |

(Continued)

FOREIGN PATENT DOCUMENTS

| | | | |
|---|---|---|---|
| JP | 2005241172 | A | 9/2005 |
| JP | 4110276 | B2 | 4/2008 |

*Primary Examiner* — Ana M Vazquez
(74) *Attorney, Agent, or Firm* — Womble Bond Dickinson (US) LLP

(57) ABSTRACT

Methods and related systems for charging a refrigerant into a climate control system. In an embodiment, the method includes (a) coupling a storage tank to a refrigerant loop of the climate control system through a charging valve; (b) opening and closing the charging valve in a plurality of cycles; and (c) flowing refrigerant from the storage tank to the refrigerant loop through the charging valve when the charging valve is open, during (b). In addition, the method includes (d) determining a detected saturated temperature of the refrigerant within the refrigerant loop after each cycle of the plurality of cycles; and (e) adjusting an amount of time that the charging valve is open during each cycle of the plurality of cycles during (b) as a function of the detected saturated temperature from a previous cycle of the plurality of cycles.

20 Claims, 4 Drawing Sheets

(56) References Cited

U.S. PATENT DOCUMENTS

| | | | | |
|---|---|---|---|---|
| 10,837,685 | B2 * | 11/2020 | Noor | F25B 41/22 |
| 2015/0059367 | A1 * | 3/2015 | Emo | F25B 45/00 62/149 |
| 2019/0061465 | A1 | 2/2019 | Hs | |

* cited by examiner

SYSTEMS AND METHODS FOR CHARGING REFRIGERANT INTO A CLIMATE CONTROL SYSTEM

CROSS-REFERENCE TO RELATED APPLICATIONS

This present application is a continuation of U.S. patent application Ser. No. 16/804,769, which was filed Feb. 28, 2020, and entitled "SYSTEMS AND METHODS FOR CHARGING REFRIGERANT INTO A CLIMATE CONTROL SYSTEM", and which is hereby incorporated by reference in its entirety.

STATEMENT REGARDING FEDERALLY SPONSORED RESEARCH OR DEVELOPMENT

Not applicable.

BACKGROUND

A climate control system may circulate a refrigerant through a fluid loop (which may be referred to herein as a "refrigerant loop") so as to exchange heat between an indoor space (e.g., a house, office, commercial store, etc.) and an outer environment surrounding the indoor space. At various points in the operational life of a climate control system, refrigerant may need to be inserted or charged into the refrigerant loop. For instance, refrigerant may be inserted within the refrigerant loop of a climate control system when the system is initially installed, or following a loss of refrigerant (e.g., such as resulting from a refrigerant leak or during a repair operation).

BRIEF SUMMARY

Some embodiments disclosed herein are directed to a method of charging a refrigerant into a climate control system. In an embodiment, the method includes (a) coupling a storage tank to a refrigerant loop of the climate control system through a charging valve, (b) opening and closing the charging valve in a plurality of cycles, and (c) flowing refrigerant from the storage tank to the refrigerant loop through the charging valve when the charging valve is open, during (b). In addition, the method includes (d) determining a detected saturated temperature of the refrigerant within the refrigerant loop after each cycle of the plurality of cycles, and (e) adjusting an amount of time that the charging valve is open during each cycle of the plurality of cycles during (b) as a function of the detected saturated temperature from a previous cycle of the plurality of cycles.

Other embodiments disclosed herein are directed to a refrigerant charging system for charging refrigerant into a refrigerant loop of a climate control system. In an embodiment, the method includes a charging valve that is configured to be coupled to a refrigerant storage tank, and a controller coupled to the charging valve. The controller is configured to: open and close the charging valve in a plurality of cycles; determine a detected saturated temperature of the refrigerant within the refrigerant loop after each cycle of the plurality of cycles; and adjust an amount of time that the charging valve is open during each cycle of the plurality of cycles as a function of the detected saturated temperature from a previous cycle of the plurality of cycles.

Still other embodiments disclosed herein are directed to a non-transitory machine-readable medium including instructions that, when executed by a processor, cause the processor to: (a) open and close a charging valve coupled between a storage tank and a refrigerant loop of a climate control system in a plurality of cycles, wherein refrigerant is configured to flow from the storage tank to the refrigerant loop through the charging valve when the charging valve is open; (b) determine a saturated temperature of the refrigerant within the refrigerant loop after each cycle of the plurality of cycles; and (c) adjust an amount of time that the charging valve is open during each cycle of the plurality of cycles during (a) as a function of the detected saturated temperature from a previous cycle of the plurality of cycles.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
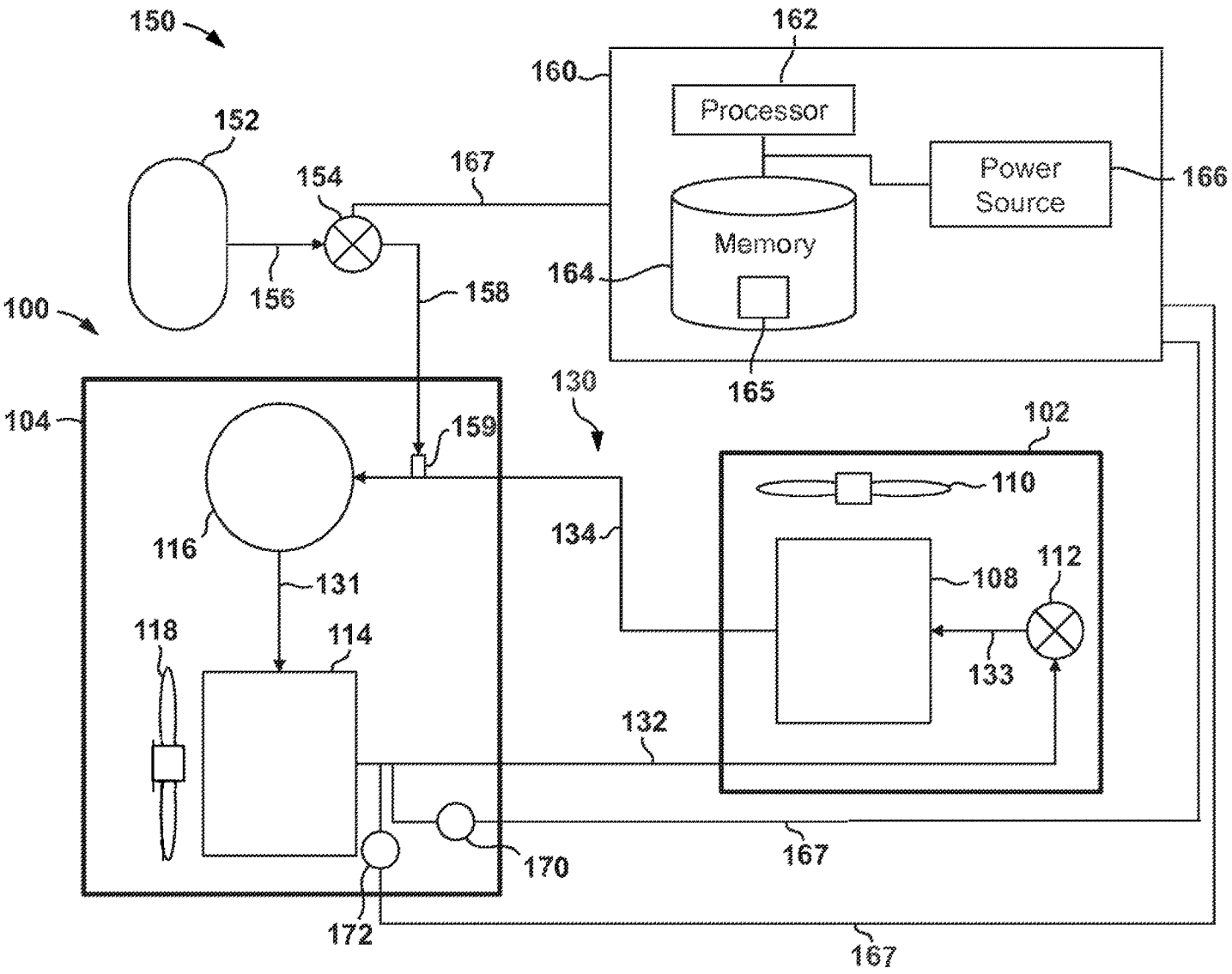
FIG. 1 is a diagram of a climate control system and refrigerant charging system according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection.

Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As used herein, a "climate control system" refers to any system, component, or collection of components that is to circulate a fluid (e.g., a refrigerant) so as to alter or affect the climate conditions (e.g., temperature, relative humidity, etc.) within a defined space (e.g., an interior space of a home, office, retail store, etc.). The term "climate control system" specifically includes (but is not limited to) air conditioning systems, heat pump systems, dehumidification systems, heating ventilation and air-conditioning (HVAC) systems, etc. In addition, as used herein a "refrigerant" may refer to any suitable fluid (e.g., heterogeneous fluid, homogeneous fluid, etc.) that may be circulated within a climate control system to affect climate conditions within a defined space as noted above. In some embodiments, a refrigerant utilized within the embodiments disclosed herein may comprise chlorofluorocarbons, hydrochlorofluorocarbons, hydrofluorocarbons, hydrocarbons, hydrofluoroolefins, or some combination thereof.

As previously described above, at various points in the operational life of a climate control system, refrigerant may need to be inserted or charged into the refrigerant loop. During these operations, a technician's aim is to provide an appropriate amount of refrigerant within the climate control system. However, inaccuracies can and often do occur as a result of human error, inaccuracies in fluid measurements or estimations, etc. As a result, in many instances, a refrigerant charging operation for a climate control system may result in an inappropriate or incorrect amount of refrigerant disposed within the refrigerant loop. Operating the climate control system with an inappropriate amount of refrigerant can result in sub-optimal operation, including a reduction in efficiency. In addition, in some instances, a technician may overfill refrigerant into the climate control system during a refrigerant charging operation. Removal of excess refrigerant can be difficult, as it may not simply be vented or expelled into the atmosphere in many jurisdictions due to environmental regulations. Avoiding overfilling the climate control system can provide a significant cost savings and reduces any negative environmental impact of the climate control system. Accordingly, embodiments disclosed herein include systems and methods for charging refrigerant into a refrigerant loop of a climate control system that are to controllably and automatically operate a charging valve based on measured variables within the climate control system so as to ensure that a proper amount of refrigerant is inserted within the refrigerant loop, while avoiding overfilling.

Referring now to FIG. 1, a schematic diagram of a climate control system 100 according to some embodiments is shown. In this embodiment, climate control system 100 is a vapor compression air conditioning system, that is configured to circulate a refrigerant through a refrigerant loop so as to provide a cooling functionality for an indoor space (e.g., such as an interior or a house, office, retail store, etc.). More particularly, as the refrigerant is circulated through the refrigerant loop of the climate control system 100, the refrigerant may transition between liquid and vapor phases in order to drive an enthalpy transfer between the air within the indoor space and the refrigerant. The climate control system 100 generally comprises an indoor unit 102, an outdoor unit 104, and a refrigerant loop 130 extending between and through the indoor unit 102 and outdoor unit 104.

Indoor unit 102 generally comprises an indoor air handling unit comprising an indoor heat exchanger 108, an indoor fan 110, and an indoor metering device 112. The indoor heat exchanger 108 may generally be configured to promote heat exchange between refrigerant carried within internal tubing of the indoor heat exchanger 108 (which makes up a portion of the refrigerant loop 130 as described in more detail below) and an airflow (e.g., generated by the indoor fan 110) that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of an indoor space. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, and an outdoor fan 118. The outdoor heat exchanger 114 may generally be configured to promote heat transfer between a refrigerant carried within internal passages or tubing of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In some embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, the outdoor fan 118 may comprise a mixed-flow fan, a centrifugal blower, and/or any other suitable type of fan and/or blower.

Refrigerant loop 130 comprises a collection of flow tubes, pipes, pathways, conduits, etc. within climate control system 100 that are configured to direct the refrigerant between and through the indoor unit 102 and outdoor unit 104 during operations. For instance, refrigerant loop 130 includes the flow lines 131, 132, 133, 134 connecting the compressor 116, outdoor heat exchanger 114, indoor metering device 112, and indoor heat exchanger 108 to one another. Specifically, the refrigerant loop 130 may comprise a first flow line 131 extending between the compressor 116 and outdoor heat exchanger 114, a second flow line 132 extending between outdoor heat exchanger and indoor metering device 112, a third flow line 133 extending between the indoor metering device 112 and indoor heat exchanger 108, and a fourth flow line 134 extending between indoor heat exchanger 108 and compressor 116. In addition, the refrigerant loop 130 includes the inner refrigerant flow passages (not specifically shown) extending through each of the compressor 116, outdoor heat exchanger 114, indoor metering device 112, and indoor heat exchanger 108. The flow lines 131, 132, 133, 134 may comprise any suitable tubes, pipes, hoses, flow channels, etc. In some embodiments, one or more of the flow lines 131, 132, 133, 134 may comprise a collection of suitable fluid flow lines (e.g., any one or more of the examples above) that are fluidly coupled together.

As shown in FIG. 1, during operations of the climate control system 100 refrigerant may be circulated through the refrigerant loop 130 so that heat is generally absorbed by the refrigerant at the indoor heat exchanger 108 and rejected from the refrigerant at the outdoor heat exchanger 114. As a result, operation of the climate control system 100 may generally reduce a temperature (and potentially a relative humidity) of an indoor space (not shown). Starting at the compressor 116, the compressor 116 may be operated to compress refrigerant and pump the relatively high temperature and high pressure compressed refrigerant to the outdoor heat exchanger 114 along flow line 131, where the refrigerant may transfer heat to an airflow that is passed through and/or into contact with the outdoor heat exchanger 114 by the outdoor fan 118. After exiting the outdoor heat exchanger 114, the refrigerant may flow along flow line 132 to the indoor metering device 112, which may meter the flow of refrigerant through the indoor metering device 112, such that the refrigerant downstream of the indoor metering device 112 (e.g., within flow line 133) is at a lower pressure than the refrigerant upstream of the indoor metering device 112 (e.g., within flow line 132). From the indoor metering device 112, the refrigerant may enter the indoor heat exchanger 108 via flow line 133. As the refrigerant is passed through the indoor heat exchanger 108, heat may be transferred to the refrigerant from an airflow that is passed through and/or into contact with the indoor heat exchanger 108 by the indoor fan 110. Refrigerant leaving the indoor heat exchanger 108 may flow along flow line 134 to the compressor 116, where the refrigeration cycle may begin again.

Referring still to FIG. 1, a refrigerant charging system 150 is shown coupled to the climate control system 100. Generally speaking, the refrigerant charging system 150 is configured to insert or charge refrigerant into the refrigerant loop 130 of climate control system 100 so as to facilitate the heat transfer operations described above. Refrigerant charging system 150 generally includes a storage tank 152, a charging valve 154, and an electronic controller 160.

The storage tank 152 may comprise any suitable vessel (or collection of vessels) that may hold or contain a volume of refrigerant for use within climate control system 100. Charging valve 154 may comprise any suitable valving element that may selectively restrict or allow a flow of fluid (e.g., refrigerant) therethrough during operations. In some embodiments, the charging valve 154 may comprise an electronically controlled valve, such as, for instance, a solenoid valve, a stepper-motor valve, etc. Charging valve 154 is coupled to the storage tank 152 via a first flow line 156. In addition, the charging valve 154 is further fluidly coupled to refrigerant loop 130 of climate control system 100 via a second flow line 158. The second flow line 158 may be fluidly coupled to fourth flow line 134, upstream of the compressor 116 and downstream of indoor heat exchanger 108 (e.g., with respect to the direction of refrigerant flow along the refrigerant loop 130 shown in FIG. 1). In particular, the second flow line 158 may be fluidly coupled to the fourth flow line 134 upstream of compressor 116 via a suitable connection or hookup 159. In some embodiments, the connection 159 may comprise a releasable connector, such as, for instance a so-called Schrader valve.

As will be described in more detail below, in some embodiments the compressor 116 may be operated to circulate refrigerant within the refrigerant loop 130 during operations. Thus, without being limited to this or any other theory, placement of the hookup 159 upstream of the compressor 116 in these embodiments may allow refrigerant to be drawn into the refrigerant loop 130 from the storage tank 152 via the negative pressure created at the suction or inlet of compressor 116 while the compressor 116 is operating. In some embodiments, the hookup 159 may be disposed at another location along refrigerant loop 130, such as, for instance on a downstream side of compressor 116.

Thus, during operations, when flow lines 156, 158 are coupled to the storage tank 152, charging valve 154, and connection 159 as shown in FIG. 1, a position of the charging valve 154 may control a flow of refrigerant from the storage tank 152 to the refrigerant loop 130. Specifically, when the charging valve 154 is open, refrigerant is free to flow from the storage tank 152 to the refrigerant loop 130, via the charging valve 154. Conversely, when the charging valve 154 is closed, refrigerant is prevented from flowing from the storage tank 152 to the refrigerant loop 130, via the charging valve 154. As was previously described above for the flow lines 131, 132, 133, 134 of refrigerant loop 130, flow lines 156, 158 of refrigerant charging system 150 may comprise any suitable conduit for flowing a refrigerant therethrough during operations. For instance, flow lines 156, 158 may comprise pipes, hoses, tubing, flow channels, or some combination thereof.

Electronic Controller 160 (or more simply "controller 160") is coupled to charging valve 154 and is generally configured to actuate the charging valve 154 to selectively open and close during operations. Generally speaking, controller 160 includes a processor 162, a memory 164, and a power source 166. The processor 162 (e.g., microprocessor, central processing unit, or collection of such processor devices, etc.) executes machine-readable instructions 165 (e.g., non-transitory machine-readable medium) provided on memory 164 to provide the processor 162 with all of the functionality described herein. The memory 164 may comprise volatile storage (e.g., random access memory), non-volatile storage (e.g., flash storage, read only memory, etc.), or combinations of both volatile and non-volatile storage. Data consumed or produced by the machine-readable instructions 165 can also be stored on memory 164.

Power source 166 provides electrical power to other electronic components within and coupled to controller 160 (e.g., processor 162, memory 164, charging valve 154, etc.). Power source 166 may comprise any suitable source of electrical power such as, for example, a battery, capacitor, a converter or transformer, etc. In addition, in some examples, controller 160 may also receive electrical power from wires or other conductors coupled to an external electrical power supply. Therefore, in some examples, power source 166 is not included in controller 160, and all electrical power is supplied to controller 160 (and other components coupled thereto) from the external electrical power supply.

A temperature sensor 172 and a pressure sensor 170 are coupled to second fluid flow line 132 of the refrigerant loop 130 downstream of the outdoor heat exchanger 114 and upstream of the indoor metering device 112 (e.g., again with respect to the direction of refrigerant flow along the refrigerant loop 130 shown in FIG. 1). Without being limited to this or any other theory, measurement of the temperature and pressure of the refrigerant within the second fluid flow line 132 of refrigerant loop 130 may facilitate analysis of the performance of the refrigerant during operations (e.g., such as subcooling as described in more detail below). However, in some embodiments one or both of the sensors 170, 172 may be disposed along other lines (e.g., lines 131, 133, 134) of refrigerant loop 130.

The temperature sensor 172 and pressure sensor 170 are configured to measure or detect a temperature and a pressure, respectively, of the refrigerant at an outlet (or on a downstream side of) the outdoor heat exchanger 114. Any suitable device or collection of devices may be utilized to serve as the temperature sensor 170 and pressure sensor 172. For instance, temperature sensor 172 may comprise a thermistor, thermocouple, etc., and pressure sensor 170 may comprise a strain gauge, capacitive pressure sensor, optical pressure sensor, etc. In some embodiments, the temperature sensor 172 and pressure sensor 170 are integrated within the refrigerant loop 130, and thus make up part of the climate control system 100. In some embodiments, the temperature sensor 172 and pressure sensor 170 are releasably coupled to the fluid flow line 132 downstream of the outdoor compressor 114. Thus, in some embodiments, the temperature sensor 172 and pressure sensor 170 may comprise a part of the refrigerant charging system 150.

Controller 160 is coupled to the temperature sensor 172 and pressure sensor 170 via a pair of communication paths 167. Similarly, the controller 160 is coupled to the charging valve 154 via another communication path 167. Communication paths 167 may comprise any suitable wired (e.g., metallic wire, optical fiber, conductive trace, etc.) and/or wireless (e.g., WIFI, BLUETOOTH®, infrared, radio frequency communications, etc.) communication path. In some embodiments, the communication paths 167 may comprise wired connections (e.g., metallic wire). During operations, power, informational and/or control signals may be transferred between controller 160 and charging valve 154, temperature sensor 172, and pressure sensor 170 via communication conduits 167.

Referring still to FIG. 1, during refrigerant charging operations, the refrigerant charging system 150 may be coupled to the climate control system 100 in the manner shown in FIG. 1, and the climate control system 100 may be operated so as to circulate refrigerant along the refrigerant loop 130 as previously described above. Correct?]]. Generally speaking, during the refrigerant charging process the controller 160 may actuate the charging valve 154 between an open and closed position in a plurality of repeating cycles (or "charging cycles") to thereby provide a pulsed or metered flow of refrigerant from the storage tank 152 into the refrigerant loop 130. At the cessation of each charging cycle, the controller 160 may assess the amount of refrigerant that was added to the refrigerant loop 130, and thereby adjust a timing of the valve actuations during the next charging cycle based on that assessment. More particularly (and as will be described in more detail below), at the cessation of each charging cycle (whereby the charging valve 154 is opened and then closed by the controller 160), the controller 160 may determine what the saturated temperature of the refrigerant is within the refrigerant loop 130, and then compare that determined value with an expected or target value of the saturated temperature. Depending on the difference between the target saturated temperature and the detected saturated temperature, the controller 160 may then adjust (e.g., increase or decrease) the amount of time that the charging valve 154 is to remain open during the next charging cycle. In some embodiments, the controller 160 may assess the amount of refrigerant that was added to the refrigerant loop 130 and adjust the timing of the valve actuations for the next charging cycle at (or potentially after) the end of the current charging cycle (e.g., at or following the cessation the fixed amount of time for the charging cycle), or following closing of the charging valve during the current charging cycle (e.g., before the end of the current charging cycle).

Without being limited to this or any other theory, the saturated temperature of the refrigerant may be a derived value that is based on the pressure of the refrigerant, downstream of the outdoor heat exchanger 114 as measured or detected by the pressure sensor 170. The saturated temperature may not represent the actual temperature of the refrigerant on the downstream side of the outdoor heat exchanger 114. Instead, the saturated temperature may correspond with a phase change temperature of the refrigerant at the pressure measured or detected by the pressure sensor 170. While the refrigerant is flowing within the outdoor heat exchanger 114 (e.g., during operation of the climate control system 100 as previously described above), heat is being transferred from the refrigerant to the outdoor environment. As a result, the refrigerant may change phase from a vapor to a liquid while flowing within the outdoor heat exchanger 114. Because the refrigerant may generally remain at the phase change temperature until all (or substantially all) of the vapor has been condensed into liquid, the calculated saturated temperature (e.g., based on the pressure measured or detected by pressure sensor 170) may provide the temperature of the refrigerant while it was flowing within the outdoor heat exchanger 114 (or the temperature of the refrigerant during a majority of the time it was flowing within the outdoor heat exchanger 114). Upon exiting the outdoor heat exchanger 114 into fluid flow line 132, the refrigerant should be in (or substantially in) a liquid phase. Thus, the flow line 132 may be referred to herein as a "liquid line" of the refrigerant during operations, and the temperature of the refrigerant within the liquid line 132 (e.g., as measured or detected by temperature sensor 172) may be referred to as the "liquid temperature" of the refrigerant.

After all of the refrigerant has changed phase from vapor to liquid, any additional temperature decrease of the refrigerant below the saturated temperature within the outdoor heat exchanger 114 may be referred to as "subcooling." Thus, if a calculated saturated temperature of the refrigerant is X° F., and an actual temperature of the refrigerant at the outlet of the outdoor heat exchanger 114 is (X° F.-2° F.), then the refrigerant may be said to have been subcooled by 2° F. (or has 2° F. of subcooling).

Further details of the refrigerant charging operation are now described below. In particular, details relating to example methods utilized by controller 160 (and/or another controller communicatively coupled to controller 160) for selectively operating charging valve 154 during a refrigerant charging operation are provided.

Figure 2:
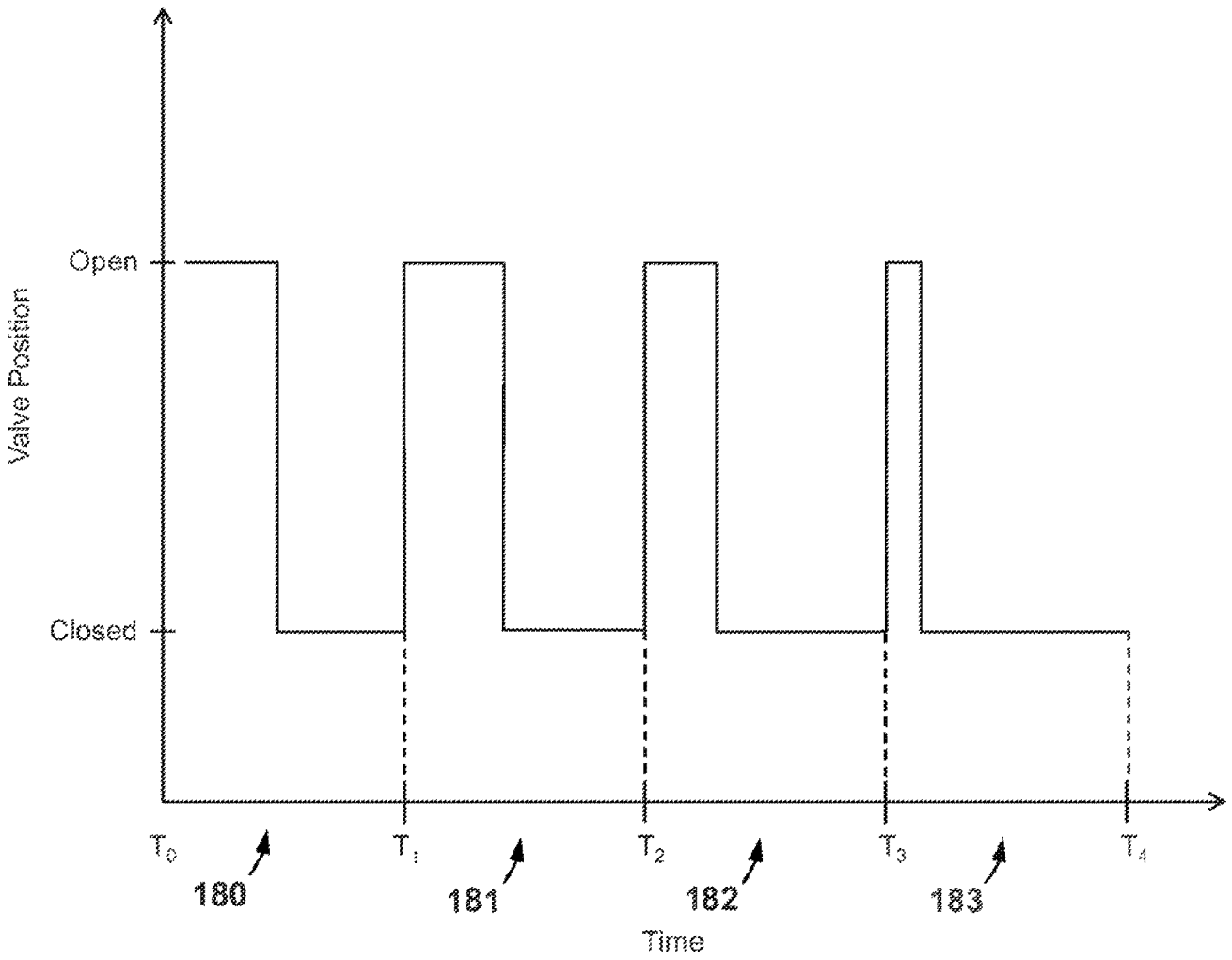
FIG. 2 is a chart of a charging valve position during a refrigerant charging operation according to some embodiments.

Referring now to FIGS. 1 and 2, during refrigerant charging operations, the refrigerant charging valve 154 may be repeatedly opened and closed in a plurality of charging cycles as previously described. In the chart of FIG. 2, a position of the charging valve 154 is depicted during an example series of charging cycles 180, 181, 182, 183. In some embodiments, each of the charging cycles 180, 181, 182, 183 may occur over a fixed period or amount of time. Specifically, the elapsed time between $T_0$ and $T_1$ for charging cycle 180 is equal to: (1) the elapsed time between $T_1$ and $T_2$ for charging cycle 181; (2) the elapsed time between $T_2$ and $T_3$ for charging cycle 182; and (3) the elapsed time between $T_3$ and $T_4$ for charging cycle 183. In addition, within each charging cycle 180, 181, 182, 183, the charging valve 154 is placed in an open position for a first portion or fraction of the elapsed time, and then is placed in a closed position for a remainder of the lapsed time. At (or at about) each of the times $T_1$, $T_2$, $T_3$, $T_4$, the controller 160 may determine the saturated temperature ($T_{SAT}$) of the refrigerant via pressure sensor 170 as previously described, and then may determine a difference or error ($\Delta T_{SAT}$) between $T_{SAT}$ and a target saturated temperature ($T_{SAT}$, TARGET) via the following expression:

$$\Delta T_{SAT}=T_{SAT,TARGET}-T_{SAT} \quad (1).$$

In some embodiments, the controller 160 may derive the target saturated temperature ($T_{SAT,\ TARGET}$) as a function of the liquid temperature of the refrigerant (e.g., the liquid temperature of the refrigerant on the downstream side of the outdoor heat exchanger 114 as measured or detected by the temperature sensor 172). For instance, additional reference is now made to FIG. 3, which shows a relationship 190 that may be derived or determined between the saturated temperature, $T_{SAT}$, and the liquid temperature of the refrigerant flowing within refrigerant loop 130 to provide the target saturated temperature, $T_{SAT,\ TARGET}$, as a function of the liquid temperature. In some embodiments, the relationship 190 may comprise a linear relationship or line that indicates or describes a direct proportionality between the liquid temperature and the saturated temperature of the refrigerant within refrigerant loop 130. In some embodiments, the relationship 190 may be defined or derived experimentally by operating the climate control system 100 (or an analogous or representative climate control system or substantial portion thereof) with a full charge or volume of refrigerant flowing therein. The predetermined relationship 190 may then be stored on the controller 160 (e.g., on memory 164) for use during refrigerant charging operations. The relationship 190 may be specific to a particular type, model, or design of climate control system (e.g., climate control system 100). Thus, controller 160 may include a plurality of relationships, like relationship 190, that are configured to provide an target saturated temperature relative to the measured liquid temperature of the refrigerant for other types, models, or designs of climate control systems. Thus, in some embodiments, controller 160 may comprise a library or catalogue of pre-determined relationships 190 that may be queried by a technician during a refrigerant charging operation so as to select and apply the proper relationship 190 based on the model, type, design, etc. of climate control system 100 being charged.

Figure 3:
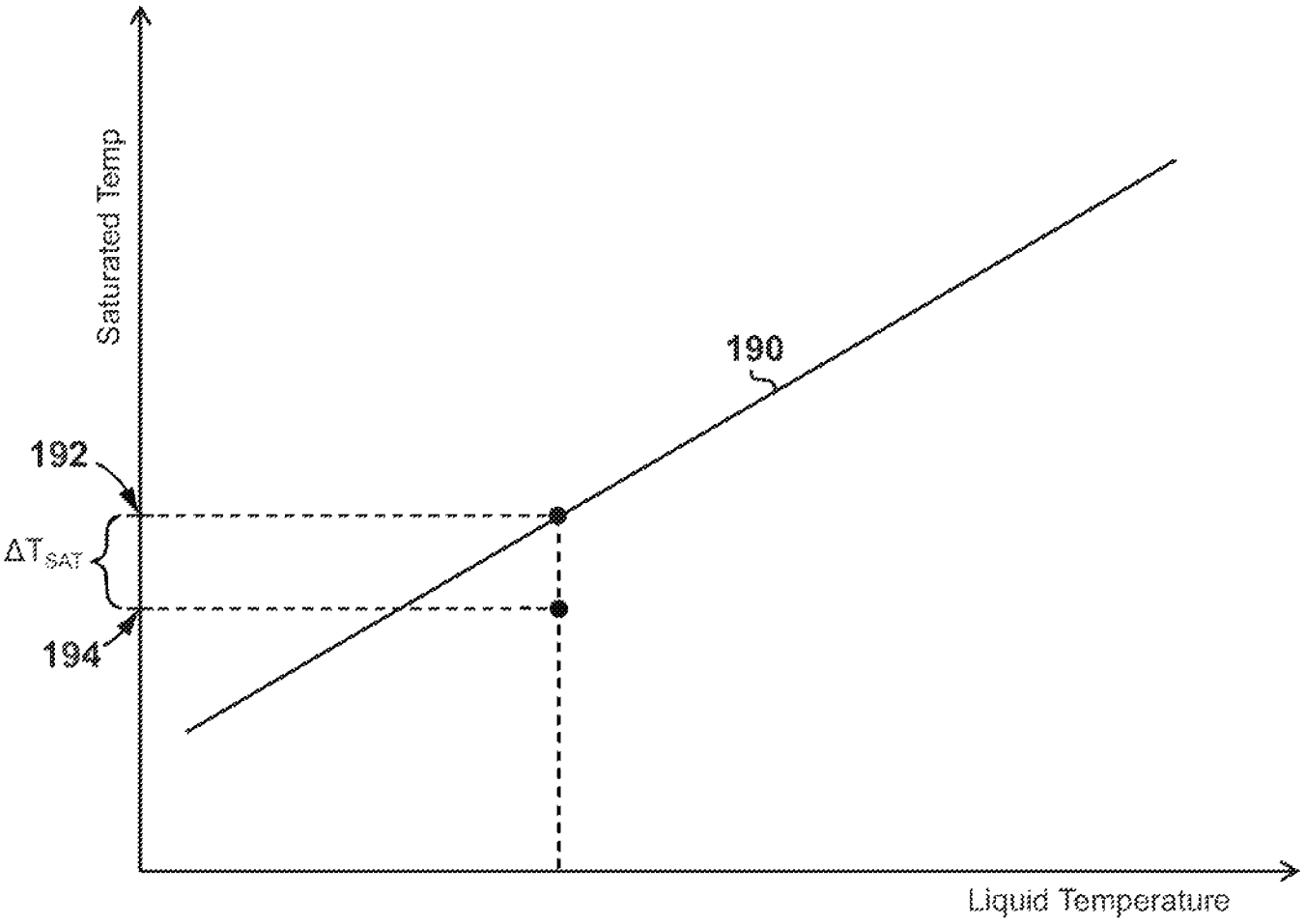
FIG. 3 is a chart showing a relationship between the saturated temperature and the liquid temperature of a refrigerant within a climate control system according to some embodiments.

Referring still to FIGS. 1-3, at (or at about) the end of each charging cycle 180, 181, 182, 183 (e.g., at times $T_1$, $T_2$, $T_3$, $T_4$, etc.) the controller 160 may determine the saturated temperature and liquid temperature of the refrigerant (e.g., along liquid line 132 via sensors 170, 172 as previously described). Thereafter, the controller 160 may determine the target saturated temperature, $T_{SAT,\ TARGET}$, via the relationship 190 (e.g., based on the measured liquid temperature as previously described) and then may compute the saturated temperature error $\Delta T_{SAT}$ per Equation (1) as previously described above. As an example, FIG. 3 shows a saturated temperature 194 that may be derived from a pressure measurement from pressure sensor 170. In addition, an target saturated temperature 192 is provided via relationship 190 at a liquid temperature detected by temperature sensor 172. Thus, the saturated temperature error $\Delta T_{SAT}$ is shown as the difference between the target saturated temperature 192 and the detected saturated temperature 194.

In addition, the controller 160 may determine a rate of change of the saturated temperature error $\Delta T_{SAT}$ over time. Specifically, controller 160 may determine a derivative of $\Delta T_{SAT}$ at the end of each charging cycle based on the change in $\Delta T_{SAT}$ since the end of the previous charging cycle. The amount of refrigerant added to the refrigerant loop 130 from storage tank 152 may be a function of the amount of time the charging valve 154 is open during a charging cycle as well as a pressure differential between the storage tank 152 and the connection 159 while the charging valve 154 is open. Thus, without being limited to this or any other theory, the derivative of $\Delta T_{SAT}$ may help to account for these multiple variables affecting the refrigerant flow rate so as to provide controller 160 with a better indication of the amount of refrigerant entering refrigerant loop 130 during the plurality of charging cycles.

The values for $\Delta T_{SAT}$ as well as the rate of change (or derivative) of $\Delta T_{SAT}$ may be inputted into a proportional and derivative (PD) control function to provide desired opening time of the refrigerant charging valve 154 in a subsequent charging cycle. During this process, the controller 160 may also utilize proportional and derivative gain values within the PD control function. These gain values may be derived experimentally or empirically and may be specific to a type, size, model, etc. of various components within the climate control system 100. In addition, in some embodiments, the derivative of $\Delta T_{SAT}$ may be averaged over a predetermined number of previous charging cycles (e.g., such as 10, 5, 3, etc. in some embodiments), and this averaged value of the time derivative may be utilized within the PD control function generally described above in place of the raw time derivative so as to filter out noise in the computation.

For an initial charging cycle (i.e., the first charging cycle of a refrigerant charging operation), the controller 160 may determine $\Delta T_{SAT}$ and the derivative thereof based on the initial charge of refrigerant within the climate control system 100 (i.e., the existing charge of refrigerant within refrigerant loop 130 prior to initiation of the refrigerant charging operations described herein), and then may adjust an opening time (or duty cycle) of the charging valve 154 for the first charging cycle in the manner described above. Thereafter, the refrigerant charging operations may proceed in the manner described herein.

The output of the PD control loop may comprise a value that represents a fraction or percentage of the next charging cycle (e.g., charging cycles 180, 181, 182, 183, etc.) wherein the charging valve 154 may remain open. In other words, the output of the PD control loop may comprise a duty cycle for the charging valve 154. Thus, at the initiation of each charging cycle 180, 181, 182, 183, the controller 160 may provide a pulse width modulation signal to the refrigerant charging valve 154 to open the valve for an amount of time (or duty cycle) dictated by the saturated and liquid temperatures of the refrigerant at the cessation of the previous charging cycle.

In some embodiments, the PD control function may include a nominal or standard duty cycle value that is adjusted or modified by the value of $\Delta T_{SAT}$, the $\Delta T_{SAT}$ derivative (or average thereof), as well as the gain values previously described above. Thus, in some embodiments, the PD control function may include the following expression:

$$Duty\ Cycle_{next} = (DC_{nom})(K_P)(\Delta T_{SAT}) + (K_D)\left(\frac{d(\Delta T_{SAT})}{dt}\right). \quad (2)$$

In Equation (2), "Duty Cycle$_{next}$" refers to the duty cycle of the charging valve 154 in the next or subsequent charging cycle, $DC_{nom}$ refers to the nominal duty cycle value, $\Delta T_{SAT}$ refers to the saturated temperature error determined by Equation (1) above, $$\frac{d(\Delta T_{SAT})}{dt}$$

refers to the derivative (or average thereof) of $\Delta T_{SAT}$, and $K_P$ and $K_D$ are the proportional and derivative gain values previously described above.

In some embodiments, a predetermined limit may be applied to the duty cycle of the refrigerant charging valve 154 during each charging cycle 180, 181, 182, 183. The predetermined limit may represent a maximum amount of time (or maximum percentage of the cycle time) that the charging valve 154 may remain open during a given charging cycle 180, 181, 182, 183. The predetermined limit may comprise a value that is less than the total time of the complete charging cycle. For instance, in some embodiments, the refrigerant charging valve 154 may be limited to 50% or less (e.g., such as 40%, 30%, 25%, 15%, etc.) of the total charging cycle time. Without being limited to this or any other theory, limiting the refrigerant charging valve 154 opening time in this manner may help to ensure that controlled amounts of refrigerant are added within the refrigerant loop 130 so as to avoid overfilling, upsetting the refrigerant cycle process itself, etc.

In addition, in some embodiments, a length of one or more of the flow lines 131, 132, 133, 134 of refrigerant loop 130 may affect one or more of the characteristics of relationship 190 (e.g., slope, axis-intercepts, etc.). For instance, as a distance between the indoor unit 102 and outdoor unit 104 increases (e.g., depending on the layout of the installation location of the climate control system 100), the length of flow lines 132, 134 may also increase. Conversely, the length of the flow lines 131, 133 may be relatively fixed or known based on the parameters and design of the indoor unit 102 and outdoor unit 104. As the length of flow lines 132, 134 increases, a desired volume of refrigerant within the refrigerant loop 130 also increases. In another example, as a difference in elevation between the indoor unit 102 and outdoor unit 104 increases (e.g., again depending on the layout of the installation location of the climate control system 100), the height that the refrigerant must be elevated as it is flows along liquid line 132 increases, so that a refrigerant pressure drop along liquid line 132 also increases. An excessive pressure drop of the refrigerant along liquid line 132 may in turn lead to an insufficient amount of subcooling within the refrigerant once it eventually reaches the indoor unit 102 (e.g., particularly the indoor heat exchanger 108). As a result, a greater amount of subcooling may be called for within the refrigerant loop 130 at a discharge of the outdoor heat exchanger 114 to counteract the increased pressure drop caused by an increased elevation difference between the indoor unit 102 and outdoor unit 104.

Thus, prior to initiating the refrigerant charging operations described above, an estimate or measurement of the fluid line lengths within refrigerant loop 130, e.g., such as the lengths of flow lines 132, 134 and/or the difference in elevation between the indoor unit 102 and outdoor unit 104 may be input into controller 160 (e.g., via any suitable user input device or component such as, for instance a button, touch-sensitive surface, voice command, encoder wheel, joystick, etc.). The inputted estimated line lengths and elevation change of refrigerant loop 130 may be utilized to alter one or more characteristics of the relationship 190 (e.g., such as the slope, axis intercepts, etc.). Because the lengths of flow lines 131, 133 may be generally known and fixed based on the type and design of indoor unit 102 and outdoor unit 104 as previously described, the experimental derivation of relationship 190 may already account for the lengths of these flow lines 131, 133 in at least some embodiments.

Referring now to FIGS. 1 and 2, during the refrigerant charging operation, pulsed volumes of refrigerant are charged into the refrigerant loop 130 of climate control system 100 during the plurality of charging cycles 180, 181, 182, 183. As a result, over time one would expect $\Delta T_{SAT}$ to decrease through the progression of charging cycles 180, 181, 182, 183, etc. as the volume of refrigerant within refrigerant loop 130 approaches a desired value. Accordingly, throughout the progression through the charging cycles 180, 181, 182, 183 the duty cycle of the charging valve 154 (e.g., again, the amount of fraction of time that the charging valve 154 is held open during each charging cycle) may decrease while progressing through the sequential charging cycles 180, 181, 182, 183, etc. Therefore, as the amount of refrigerant within the refrigerant loop 130 approaches the desired or target amount (e.g., which may be defined by the relationship 190 in FIG. 3), the pulses of added refrigerant into the loop 130 decrease within each charging cycle 180, 181, 182, 183 so that the desired or target amount is approached at a progressively slower rate. Without being limited to this or any other theory, by slowing the rate of refrigerant addition into the refrigerant loop 130 when approaching the target or desired volume, the risks of overfilling refrigerant into the refrigerant loop 130 is generally reduced.

Eventually, the value of $\Delta T_{SAT}$ may approach zero (or substantially zero) so that controller 160 may prevent a subsequent charging cycle from occurring and the refrigerant charging operations are ceased. In some embodiments, refrigerant charging operations may cease when the value of $\Delta T_{SAT}$ is equal to zero. Alternatively, in some embodiments, refrigerant charging operations may cease when the value of $\Delta T_{SAT}$ is within a predetermined range of zero. The magnitude and endpoints of the range of values of $\Delta T_{SAT}$ for ceasing further refrigerant charging cycles from occurring may be selected based on a range of factors such as, for instance, the resolution of the pressure and temperature sensors 170, 172, the actuation speed and response of the charging valve 154, the communication speed between the controller 160, sensors 170, 172, valve 154, etc.

Figure 4:
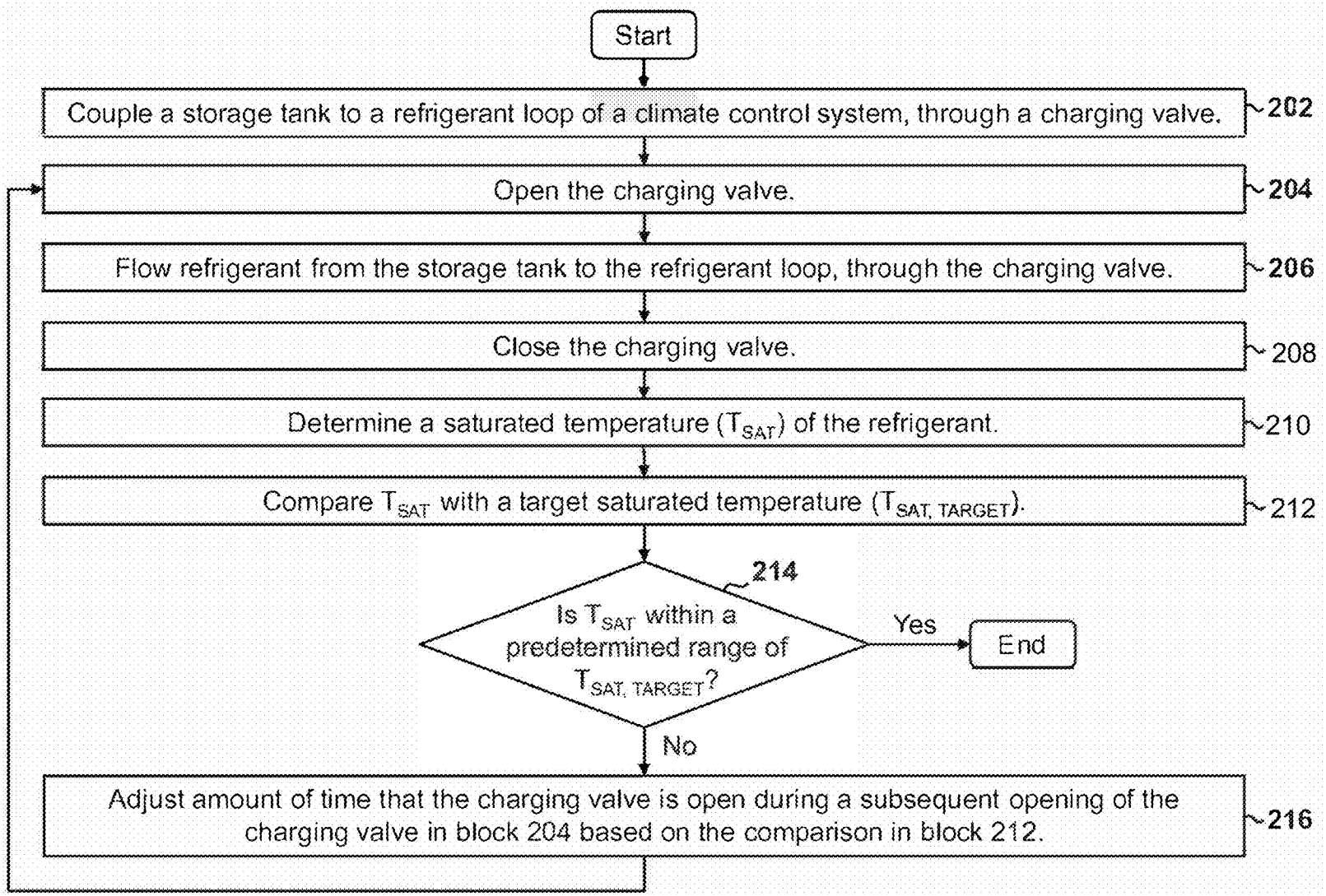
FIG. 4 is a block diagram of a method of charging a refrigerant into a climate control system according to some embodiments.

Referring now to FIG. 4, a method 200 of charging a refrigerant into a climate control system is shown. In describing method 200, reference may be made to the climate control system 100 and refrigerant charging system 150 of FIG. 1; however, it should be appreciated that method 200 may be practiced with systems and components that are different from those shown in FIG. 1 and described above. Accordingly, reference to climate control system 100 and refrigerant charging system 150 should not be interpreted as limiting the other possible implementations of method 200 in various embodiments. In addition, at least some features of method 200 may be practiced (e.g., wholly or partially) by a controller (e.g., controller 160) or a plurality of controllers (e.g., controller 160 and/or one or more other controllers that are communicatively coupled to controller 160).

Initially, method 200 may include coupling a storage tank to a refrigerant loop of a climate control system through a charging valve at block 202. For instance, the storage tank 152 of refrigerant charging system 150 is coupled to refrigerant loop 130 of climate control system 100 through a charging valve 154 via the connection 159 as previously described above.

Next, method 200 includes opening the charging valve at block 204, flowing refrigerant from the storage tank to the refrigerant loop, through the charging valve at block 206, and closing the charging valve at block 208. Blocks 204, 206, 208 may be performed while operating the climate control system to circulate refrigerant within the refrigerant loop. As previously described for the refrigerant charging system 150, the charging valve 154 may be actuated through a plurality of charging cycles whereby the charging valve 154 may be actuated to an open position, and then, after a predetermined period of time within the charging cycle, the charging valve 154 may be actuated to a closed position. When the charging valve 154 is in the open position, refrigerant may flow from the storage tank to the refrigerant loop 130, via the charging valve 154 as previously described. Accordingly, blocks 204, 206, 208 may represent a charging cycle of the charging valve during method 200.

In addition, method 200 includes determining a saturated temperature ($T_{SAT}$) of the refrigerant at block 210, and then comparing $T_{SAT}$ with a target saturated temperature ($T_{SAT,\ TARGET}$) in block 212. In some embodiments, comparing $T_{SAT}$ to $T_{SAT,\ TARGET}$ may comprise computing a difference between $T_{SAT}$ to $T_{SAT,\ TARGET}$ to provide a saturated temperature error ($\Delta T_{SAT}$), such as for instance as shown in above in Equation (1). In some embodiments, the value of $T_{SAT,\ TARGET}$ may correspond to a full charge of refrigerant within the refrigerant loop. In some embodiments, the value of $T_{SAT,\ TARGET}$ may be offset (or buffered) by a predetermined amount so as to reduce a likelihood of overcharging refrigerant within the refrigerant loop as previously described above.

Next, method 200 proceeds to determine whether $T_{SAT}$ is within a predetermined range of $T_{SAT,\ TARGET}$ at block 214. In some embodiments, the determination in block 214 may be made by determining whether $\Delta T_{SAT}$ (e.g., an absolute value of $\Delta T_{SAT}$) is below a predetermined limit (e.g., <1° F., 1° F., 2° F., 3° F., 4° F., 5° F., etc.). In some embodiments, the predetermined range in block 214 may equal or approach zero, so that the determination at block 214 may comprise determining whether $T_{SAT}$ is equal (or substantially equal) to $T_{SAT,\ TARGET}$.

If it is determined at block 214 that $T_{SAT}$ is not within the predetermined range of $T_{SAT,\ TARGET}$ (i.e., the determination at block 214 is "No"), then method 200 proceeds to adjust the amount of time that the charging valve is open during a subsequent opening of the charging valve at 204 based on the comparison from block 212 at block 216. In some embodiments, block 216 may comprise inputting the value for $\Delta T_{SAT}$ along with its derivative (or average thereof) into a PD control function (e.g., such as that shown above in Equation (2)) to determine a desired opening time (or duty cycle) for the charging valve during the next charging cycle. As a result, the duty cycle adjustments to the charging valve may be based on a comparison of the $T_{SAT}$ and $T_{SAT,\ TARGET}$ at the end of each charging cycle (e.g., charging cycles 180, 181, 182, 183, etc. in FIG. 2).

Following block 216, method 200 includes recycling or returning to block 204 to once again open the charging valve and thereby reinitiate the flow of refrigerant through the charging valve into the refrigerant loop of the climate control system. Thus, the return to block 204 may represent the initiation of a new charging cycle for the charging valve (e.g., charging valve 154). However, at the repeated performance of block 204, the amount of time that the charging valve may remain open (e.g., the amount of time between the performance of block 204 and the performance of block 208) may be adjusted or set based on the adjustments made via blocks 210-214 as previously described above.

Blocks 204-216 may be repeated a plurality of times during method 200 so as to provide a pulsed flow of refrigerant from the storage tank into the refrigerant loop until a desired volume of refrigerant is achieved (e.g., which may be indicated by a value of the refrigerant saturated temperature being equal to or sufficiently approaching the target saturated temperature as previously described above). Specifically, blocks 204-216 may be repeated until the determination is made at block 214 that $T_{SAT}$ is within the predetermined range of $T_{SAT, TARGET}$ as previously described above (i.e., the determination at block 214 is "Yes"). When the determination at block 214 is "Yes," it may be presumed that a full charge (or sufficiently full charge) of refrigerant has been placed within the refrigerant loop (e.g., refrigerant loop 130) of the climate control system. As a result, upon an affirmative (or "Yes") determination at block 214, method 200 may end and further charging cycles of the charging valve may be prevented.

Embodiments disclosed herein include systems and methods for charging refrigerant into a refrigerant loop of a climate control system. In some embodiments, the disclosed systems and methods may controllably and automatically operate a charging valve so as to provide a pulsed flow of refrigerant into the refrigerant loop. In some embodiments, the measured variables within the climate control system may be monitored, and the actuation of the charging valve during the refrigerant charging operation may be based on these measured variables so as to ensure that a proper amount of refrigerant is inserted within the refrigerant loop, while avoiding overfilling. Thus, through use of the disclosed systems and methods disclosed herein, the accuracy and efficiency of a refrigerant charging operation may be improved.

While the climate control system 100 shown in FIG. 1 is a so-called vapor compression air conditioning system, it should be appreciated that the systems and methods described herein (e.g., refrigerant charging system 150, method 200, etc.) may be utilized with other types of climate control systems. For instance, in some embodiments, the climate control system 100 may be configured as a so-called "heat pump" whereby the flow direction of the refrigerant within the refrigerant loop may be reversed from that shown in FIG. 1 and described above so as to increase a temperature of the indoor space (not shown). Refrigerant charging operations utilizing the refrigerant charging system 150 along with a climate control system configured as a heat pump may be generally the same as that described above. In some embodiments, the heat pump climate control system may be operated in a so-called "cooling mode" which may have a refrigerant circulation that is generally similar to that shown in FIG. 1 for climate control system 100 during the refrigerant charging operations.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A climate control system comprising:

a refrigerant loop for circulating refrigerant within the climate control system;

a connection associated with the refrigerant loop, the connection configured to couple to a charging valve to supply refrigerant into the refrigerant loop; and a controller configured to:

cause the charging valve to open and close in a plurality of cycles when the charging valve is coupled to the connection;

determine a detected saturated temperature of the refrigerant within the refrigerant loop after each cycle of the plurality of cycles; and adjust an amount of time that the charging valve is open during each cycle of the plurality of cycles as a function of the detected saturated temperature from a previous cycle of the plurality of cycles.

2. The climate control system of claim 1, wherein the connection includes a releasable connection.

3. The climate control system of claim 1, wherein the controller configured to adjust the amount of time that the charging valve is open during each cycle is further configured to adjust the amount of time as a function of a difference between a target saturated temperature and the detected saturated temperature from the previous cycle of the plurality of cycles.

4. The climate control system of claim 1, further comprising a pressure sensor coupled to the refrigerant loop at a discharge side of a heat exchanger of an outdoor unit, and wherein the controller configured to determine the detected saturated temperature is further configured to determine the detected saturated temperature based on the pressure.

5. The climate control system of claim 1, wherein the controller configured to determine the detected saturated temperature is further configured to determine a target saturated temperature based on a predetermined relationship between the detected saturated temperature and a liquid temperature of the refrigerant loop, wherein the liquid temperature of the refrigerant loop is determined at a discharge side of a heat exchanger of an outdoor unit of the climate control system.

6. The climate control system of claim 5, wherein the predetermined relationship is derived based on a full charge of refrigerant within the refrigerant loop.

7. The climate control system of claim 1, wherein the controller configured to adjust the amount of time that the charging valve is open during each cycle is further configured to adjust the amount of time that the charging valve is open during each cycle as a function of difference between a target saturated temperature and the detected saturated temperature, and a time derivative of the difference.

8. The climate control system of claim 1, wherein the controller configured to adjust the amount of time that the charging valve is open during each cycle is further configured to adjust the amount of time that the charging valve is open by adjusting a duty cycle of the charging valve during each cycle according to the following expression:

$$\text{Duty Cycle} = (DC_{nom})(K_P)(\Delta T_{SAT}) + (K_D)\left(\frac{d(\Delta T_{SAT})}{dt}\right),$$

wherein $DC_{nom}$ comprises a nominal duty cycle value, $\Delta T_{SAT}$ comprises a difference between a target saturated temperature and the detected saturated temperature, $$\frac{d(\Delta T_{SAT})}{dt}$$

comprises a time derivative of $\Delta T_{SAT}$, and $K_P$ and $K_D$ comprise constant values.

9. The climate control system of claim 8, wherein the controller configured to adjust the amount of time that the charging valve is open during each cycle is further configured to limit the duty cycle of the charging valve during each cycle to a predetermined amount of time that is less than a total time of each cycle.

10. The climate control system of claim 1, wherein each of the plurality of cycles has a fixed duration.

11. The climate control system of claim 1, wherein the controller configured to determine the detected saturated temperature is further configured to determine a target saturated temperature based on at least one of:

a length of a fluid flow line of the climate control system; or a difference in elevation between an outdoor unit and an indoor unit of the climate control system.

12. A controller for directing a charging of refrigerant into a refrigerant loop of a climate control system, the controller comprising:

a memory configured to store computer-readable program code including a refrigerant charging-related software application; and a processor configured to access the memory, and execute the computer-readable program code including the refrigerant charging-related software application to cause the processor to at least:

control a charging valve coupled to the refrigerant loop to open and close in a plurality of cycles, the charging valve configured to supply refrigerant to the refrigerant loop of the climate control system;

receive a detected saturated temperature of the refrigerant within the refrigerant loop after each cycle of the plurality of cycles; and adjust an amount of time that the charging valve is open during each cycle of the plurality of cycles as a function of the detected saturated temperature from a previous cycle of the plurality of cycles.

13. The controller of claim 12, wherein the processor configured to access the memory, and execute the computer-readable program code including the refrigerant charging-related software application to cause the processor to adjust the amount of time that the charging valve is open during each cycle further causes the processor to adjust the amount of time as a function of a difference between a target saturated temperature and the detected saturated temperature from the previous cycle of the plurality of cycles.

14. The controller of claim 12, wherein the processor configured to access the memory, and execute the computer-readable program code including the refrigerant charging-related software application to cause the processor to adjust the amount of time that the charging valve is open during each cycle further causes the processor to adjust the amount of time as a function of a difference between a target saturated temperature and the detected saturated temperature, and a time derivative of the difference.

15. The controller of claim 14, wherein the processor configured to access the memory, and execute the computer-readable program code including the refrigerant charging-related software application to cause the processor to adjust the amount of time that the charging valve is open during each cycle further causes the processor to limit a duty cycle of the charging valve during each cycle to a predetermined amount of time that is less than a total time of each cycle.

16. The controller of claim 12, wherein the processor configured to access the memory, and execute the computer-readable program code including the refrigerant charging-related software application to cause the processor to adjust the amount of time that the charging valve is open during each cycle further causes the processor to adjust the amount of time that the charging valve is open during each cycle is further configured to adjust the amount of time that the charging valve is open by adjusting a duty cycle of the charging valve during each cycle according to the following expression:

$$\text{Duty Cycle} = (DC_{nom})(K_P)(\Delta T_{SAT}) + (K_D)\left(\frac{d(\Delta T_{SAT})}{dt}\right),$$

wherein $DC_{nom}$ comprises a nominal duty cycle value, $\Delta T_{SAT}$ comprises a difference between a target saturated temperature and the detected saturated temperature, $$\frac{d(\Delta T_{SAT})}{dt}$$

comprises a time derivative of $\Delta T_{SAT}$, and $K_P$ and $K_D$ comprise constant values.

17. The controller of claim 12, wherein each of the plurality of cycles has a fixed duration.

18. A non-transitory machine-readable medium including instructions that, when executed by a processor, cause the processor to:

(a) open and close a charging valve coupled between a storage tank and a refrigerant loop of a climate control system in a plurality of cycles, wherein refrigerant is configured to flow from the storage tank to the refrigerant loop through the charging valve when the charging valve is open;

(b) receive a detected saturated temperature of the refrigerant within the refrigerant loop after each cycle of the plurality of cycles; and (c) adjust an amount of time that the charging valve is open during each cycle of the plurality of cycles during (a) as a function of the detected saturated temperature from a previous cycle of the plurality of cycles.

19. The non-transitory machine-readable medium of claim 18, wherein the instructions, when executed by the processor, further cause the processor to adjust the amount of time that the charging valve is open during each cycle during (a) as a function of a difference between a target saturated temperature and the detected saturated temperature.

20. The non-transitory machine-readable medium of claim 18, wherein the instructions, when executed by the processor, further cause the processor to adjust a duty cycle of the charging valve during each cycle of the plurality of cycles to adjust the amount of time that the charging valve is open during each cycle, and wherein the instructions, when executed by the processor, further cause the processor to adjust the duty cycle of the charging valve according to the following expression:

$$\text{Duty Cycle} = (DC_{nom})(K_P)(\Delta T_{SAT}) + (K_D)\left(\frac{d(\Delta T_{SAT})}{dt}\right),$$

wherein $DC_{nom}$ comprises a nominal duty cycle value, $\Delta T_{SAT}$ comprises a difference between a target saturated temperature and the detected saturated temperature, $$\frac{d(\Delta T_{SAT})}{dt}$$

comprises a time derivative of $\Delta T_{SAT}$, and $K_P$ and $K_D$ comprise constant values.

* * * * *